US005232376A

United States Patent [19]

Wen

[11] Patent Number: 5,232,376

[45] Date of Patent: Aug. 3, 1993

[54] HIGH-VOLTAGE CONNECTOR ASSEMBLY

[75] Inventor: Chuan Wen, Duiven, Netherlands

[73] Assignee: Claymount Assemblies B.V., Didam, Netherlands

[21] Appl. No.: 888,654

[22] Filed: May 27, 1992

[30] Foreign Application Priority Data

May 27, 1991 [NL] Netherlands ..... 9100909

[51] Int. Cl.[5] ..... H01R 13/00

[52] U.S. Cl. ..... 439/271

[58] Field of Search ..... 439/271-282

[56] References Cited

U.S. PATENT DOCUMENTS

| | | | |
|---|---|---|---|
| 2,542,056 | 2/1951 | Ravenscroft | 439/271 |
| 2,655,638 | 10/1953 | Allen | 439/271 |
| 4,335,928 | 2/1962 | Barrett et al. . | |
| 4,494,811 | 1/1985 | Palermo, Jr. | 439/271 |

FOREIGN PATENT DOCUMENTS 0272983 6/1988 European Pat. Off. .

*Primary Examiner*—Joseph H. McGlynn

*Attorney, Agent, or Firm*—Jacobson, Price, Holman & Stern

[57] ABSTRACT

High-voltage connector assembly, comprising a male connector, a female connector, and fixing means for fixing the connectors. The female connector has a connector socket part with contacts fixed thereto, for accommodating therein with space a plug member of the male connector. A rigid ring is provided at the opening of the connector socket part for sealing the space between the plug member and connector socket part, which ring is provided with at least one inner sealing ring which sealingly engages the plug member.

10 Claims, 3 Drawing Sheets

HIGH-VOLTAGE CONNECTOR ASSEMBLY

BACKGROUND OF THE INVENTION

The invention relates to a high-voltage connector assembly, comprising a male connector, a female connector, and fixing means for fixing the connectors to each other. The female connector has a connector socket part with contacts fixed thereto, for accommodating therein with space a plug member of the male connector. A rigid ring is provided at the opening of the connector socket part for sealing the space between the plug member and connector socket part. The ring is provided with at least one inner sealing ring which sealingly engages the plug member. A prior art connector assembly is disclosed in U.S. Pat. No. 4,494,811.

In the prior art connector assembly, a cylindrical rubber ring is installed on the male connector, which has a relatively large diameter. This ring is placed in the space bounded by the cylinder side of the male connector, an enlarged flat side of the male connector, the inside of a locking ring on the female connector, and the flat side of the female connector. This ring is very tightly and firmly pressed against both the enlarged side of the male connector and the flat side of the female connector, in order to prevent leakage of oil between the male connector and the female connector.

The type of seal described above is possible only if a male connector with a large flange diameter is used, which produces problems in the case of many medical x-ray units, such as the units in which a C-arm construction is used. In the case of this construction, at the time of installation the male connector for the unit must be passed through a small-diameter pipe before being plugged into the female connector. The type of seal can thus be used only to a limited extent.

SUMMARY OF THE INVENTION

The object of the invention is to provide a high-voltage connector assembly, in which the seal is improved and the above-mentioned problems are also avoided.

This object is achieved according to the invention by providing that at least a part of the rigid ring extends inside the space between the connector plug-in (hereinafter also referred to as "plug member") and the connector socket part and is provided with at least one outer sealing ring sealingly engaging inside wall of the connector socket part. As a result a broad flange is no longer needed.

The thickness of the rigid ring is preferably substantially uniform along its length. A relatively thin rigid ring with sealingly rings can therefore be used and the desired small diameter measurement on the connector assembly is met.

BRIEF DESCRIPTION OF THE DRAWINGS

The invention will be explained in greater detail below with reference to the drawings. In the drawings.

DETAILED DESCRIPTION OF THE DRAWINGS

Figure 1:
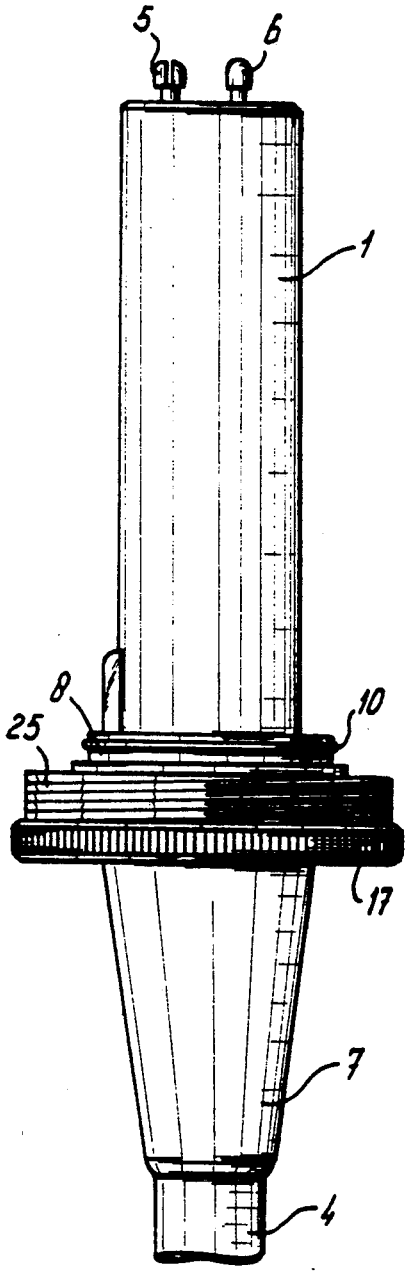
FIG. 1 shows a side view of a male connector according to the invention.

It is pointed out that it is assumed in the whole description that the gaps between the parts of the female connector and the fixing parts thereof are already sealed. In other words, for the sake of clarity, the female connector and the fixing parts are shown as one element.

The male connector comprises a connector plug-in part 1 (plug member) which is provided with an outward projecting rim 2 around which the top end part of the fixing ring for a cable 4 is flanged. The cores (not shown) of the cable 4 are passed through the connector plug-in part 1 and are connected to the contacts 5 and 6.

The end part of the cable 4 is embedded together with the fixing ring 3 in a galvanized insulation material 7, so that the connector plug-in part 1 and the cable 4 are integral. The embodiment of the fixing ring 3 can be seen clearly from FIG. 3.

Figure 2:
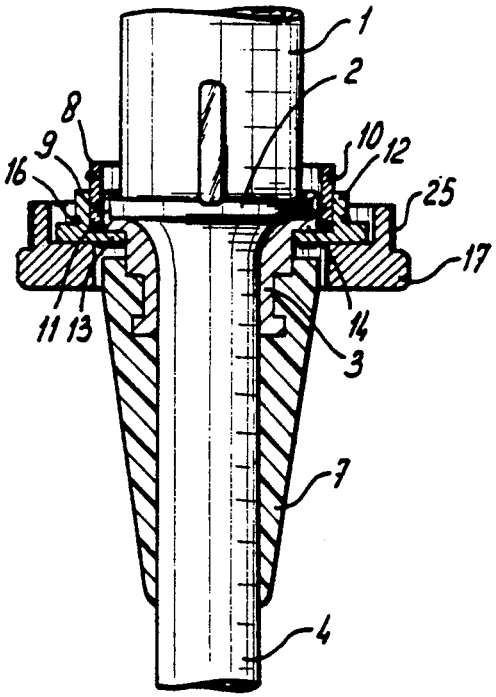
FIG. 2 shows a cross-section through the male connector according to FIG. 1.
Figure 3:
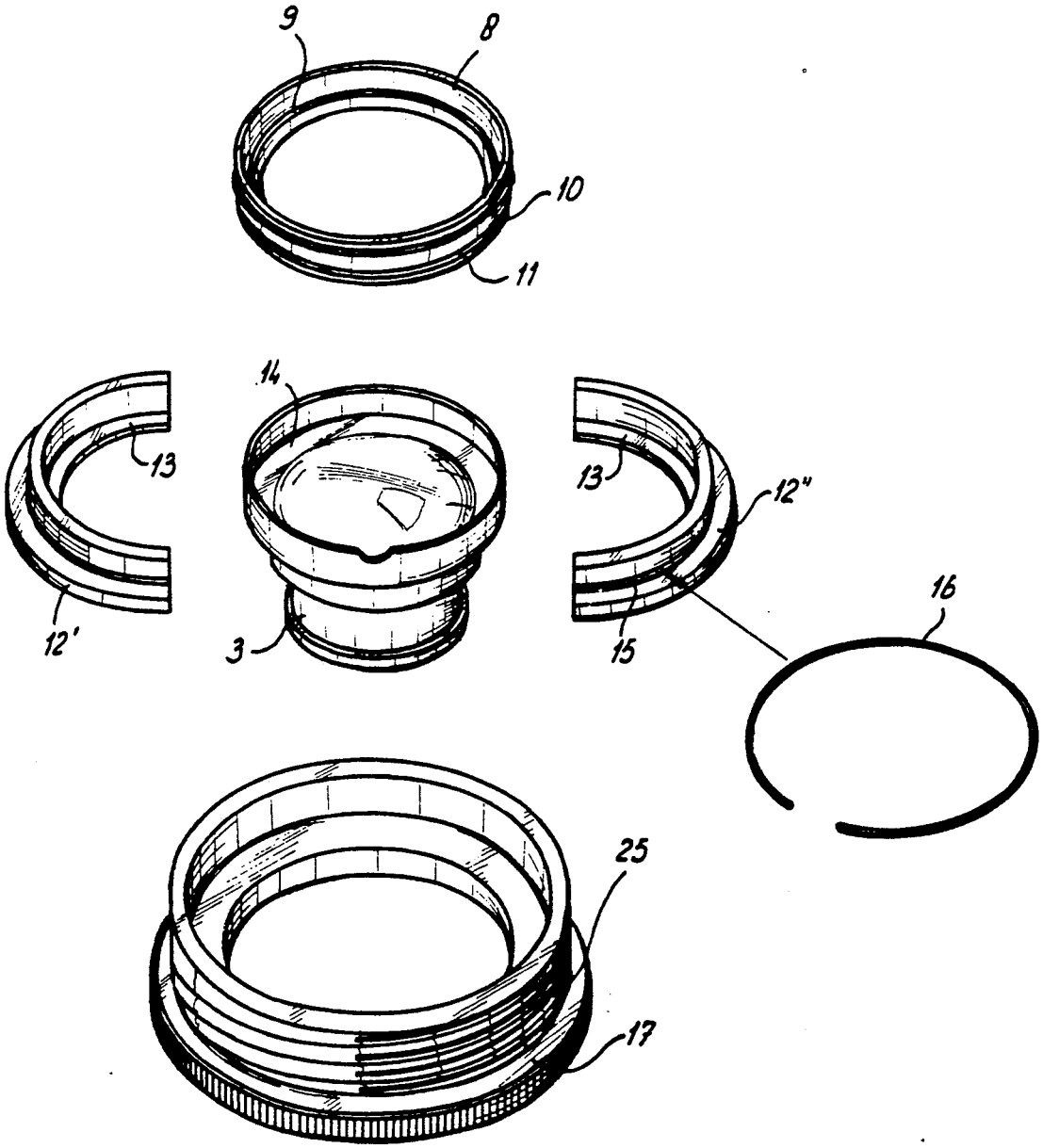
FIG. 3 shows a number of parts of the male connector according to FIG. 1, dismantled.

FIGS. 1, 2 and 3 also show a rigid ring 8, which is made of, for example, copper. This rigid ring is provided with two rubber O-rings 9 and 10, one on the inside, and the other on the outside of the rigid ring. The ring 8 is also provided with a peripheral groove 11 on its outside, which groove serves for easy removal of the plug-in part from the female connector shown in FIG. 4. It is clear that, if desired, more than two O-rings can be used, i.e. two or more inner and two or more outer O-rings. The O-rings must be made of very oil-resistant and temperature-resistant material, for example a polymer with the desired properties.

The O-ring 9 fitted on the inside of the rigid ring 8 sealingly engages the fixing ring 3, which is, for example, in the form of a copper socket. This O-ring prevents oil leakage between the copper fixing ring 3 and the rigid ring 8.

The O-ring 10 is fitted on the outside of the rigid ring 8 extending at least partially until inside the space between the connector plug-in and connector socket parts 1, 18 respectively. The O-ring 10 serves to prevent oil leakage between the rigid ring 8 and the connector socket part 18 of the female connector shown in FIG. 4.

The rigid ring is preferably the cylindrical ring shape down, but it can be of any shape, provided that it rests with the O-ring 10 in a sealing manner against the inside wall of the connector socket part 18.

The flange ring 2 shown in FIGS. 1, 2 and 3 is provided with a flange 13 whose top face rests against a flange 14—formed by a recess—of the fixing ring 3. The diameter of the flange ring 12 above the flange part 13 is greater than the external diameter of the fixing ring 3, so that between the inside wall of the flange ring 12, the top face of the flange 13 and the outer periphery of the top end of the fixing ring 3, a space is bounded. In this space, a part of the rigid ring 8 and the O-ring 9 can be accommodated.

The flange ring 12 is preferably composed of two parts, which two parts 12' and 12" are shown more clearly in FIG. 3. The half rings 12' and 12" are provided with a peripheral groove 15 in which a spring washer 16 can be accommodated at least partially, in order to hold together the two parts of the flange ring 3 after it is fitted around the fixing ring 3.

FIGS. 1, 2 and 3 also show a locking nut 17 which fixes together the two connectors once the male connector is plugged into the female connector. This will be discussed in greater detail with reference to FIG. 4.

Figure 4:
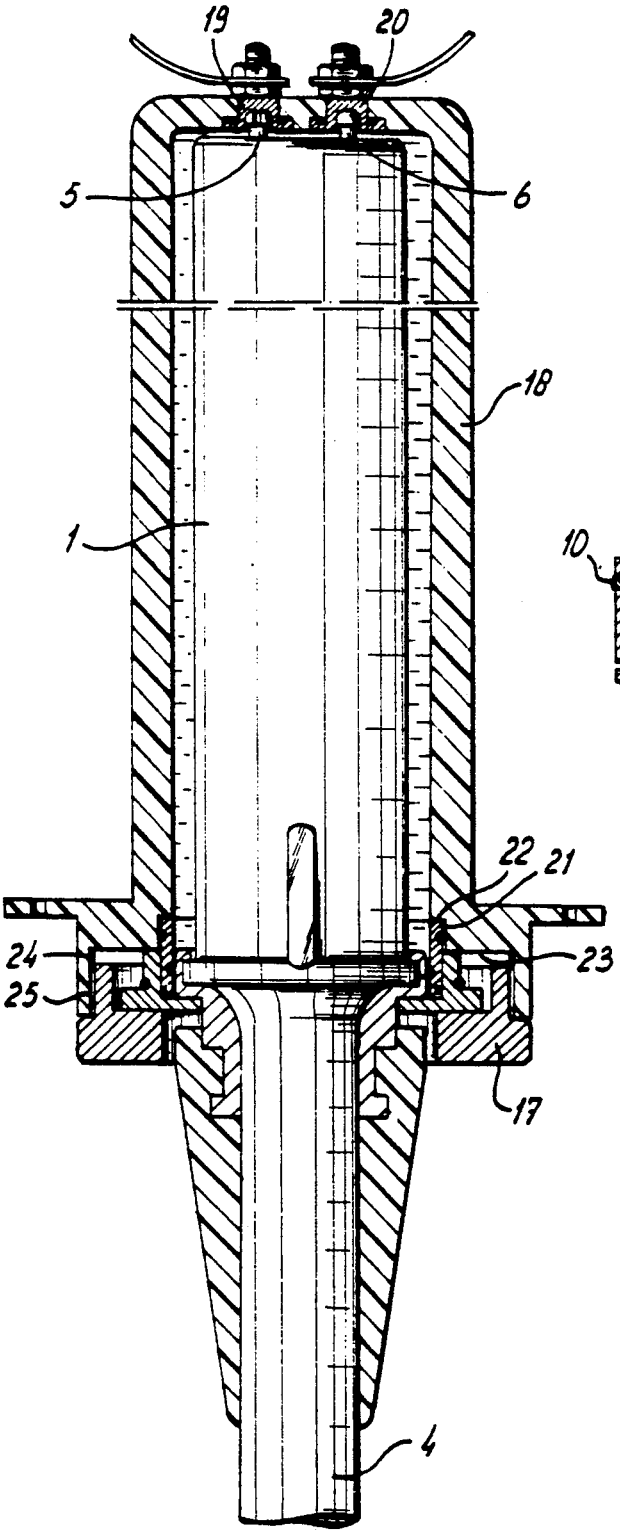
FIG. 4 shows a connector assembly according to the invention.

The female connector shown in FIG. 4 comprises a socket-shaped connector socket part 18, into which the connector plug-in part 1 must be plugged. When the connector parts are plugged in, a space is bounded between them, in which oil or other insulating material can be placed. Fitted on the bottom of the connector socket part are the contacts 19 and 20, which interact with the contacts 5 and 6 of the connector plug-in part 1.

Provided near the open end of the connector socket part 18 is a recess 21, the face 22 of which serves as a nesting face for the rigid ring 8. Depending on the measurements, the flange ring 12 can rest with its end against or at a distance from the face 23 of the connector socket part 18.

The connector socket part is also provided with screw thread 24, onto which the screw thread 25 of the locking nut 17 must be screwed in order to fix the male connector and the female connector together.

When the half flange rings 12′ and 12″ and the spring washer belonging to them are fitted on the fixing ring, the rigid ring can be put in place on the male connector. Thereafter, the male connector is pressed into the female connector, following which the locking ring can be screwed onto the connector assembly.

The split flange ring 12 has the advantage that it need only be fitted on the male connector when it has been passed through the earlier mentioned thin tube.

It is clear that such a split ring can give rise to sealing problems, in particularly at the interfaces. It was found, surprisingly, that the rigid ring with the sealing rings fitted on it produces an excellent seal.

Figure 5:
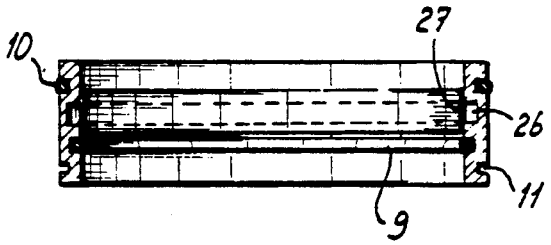
FIG. 5 shows on an enlarged scale the rigid ring provided with sealing rings according to the invention.

If desired, in an embodiment of the rigid ring shown in FIG. 5, the ring can be provided with a recess 26, the opening of which is sealed by the membrane 27. This recess and the associated membrane serve as a relief for the oil used in the connector assembly at very high temperatures. The recess can, of course, be made annular, something which is not essential.

When the male connector has to be removed from the female connector, the tip of a screwdriver can be inserted into the groove 11 of the rigid ring 8, and the connector plug-in part can be pressed out of the socket part by pressing the face of the screwdriver against the end face of the connector socket part.

The invention can advantageously be used on connectors of the IEC 526/1975, 1978 type, but it is, of course, not limited thereto. The invention is also suitable either for an oil-filled or a grease-filled connector assembly.

Through the invention the use of connectors is extended, inter alia, to all possible types of medical x-ray equipment, in particular where a female connector of the IEC 526/1975, 1978 type is installed.

The rigid ring with sealing rings according to the invention is not only easy to produce, but also easy to handle and fit.

It is clear that different variants are possible within the scope of the invention:

I claim:

1. High-voltage connector assembly comprising a male connector having a plug member with contacts, a female connector capable of receiving the male connector, and fixing means for fixing together the male and female connectors once they are connected to each other, the female connector comprising a connector socket part having contacts fixed thereto, for accommodating therein with space to spare the plug member of the male connector, a rigid ring being provided at the opening of the connector socket part for sealing the space between the plug member and connector socket part, the ring being provided with at least one inner sealing ring which interacts in a sealing manner with the plug member, at least a part of rigid ring extends inside the space between the plug member and the connector socket part and is provided with at least one outer sealing ring sealingly engaging an inside wall of the connector socket part.

2. Connector assembly according to claim 1, wherein the connector socket part comprises at an open end a nesting face for an end face of the part of the rigid ring supporting the outer sealing ring.

3. Connector assembly according to claim 1, wherein the thickness of the rigid ring is substantially uniform along its length.

4. Connector assembly according to claim 3, wherein the sealing inner and outer sealing rings lie at intervals along the length of the rigid ring.

5. Connector assembly according to claim 1, wherein the rigid ring is provided with a peripheral groove at an end facing away from a free end of the male connector.

6. Connector assembly according to claim 5, the inward facing opening of the recess closed by a flexible membrane.

7. Connector assembly according to claim 6, and further comprising a locking nut for locking the flange ring and the rigid ring.

8. Connector assembly according to claim 1, and further comprising a flange ring having a flange which grips behind a rim provided on a rear end of the plug member, which rim extends perpendicular to a longitudinal axis of the plug member and faces away from a front end of the plug member, and an internal diameter of a part of the flange ring adjoining the flange of the flange ring being greater than an external diameter of a part of the plug member adjoining the flange ring for defining a nesting space for the part of the rigid ring supporting the inner sealing ring.

9. Connector assembly according to claim 8, wherein the flange ring comprises at least two parts, interfaces of which extend along a direction of a central axis of the connector assembly.

10. Connector assembly according to claim 9, wherein an outer wall of the flange ring is provided with a groove for at least partially accommodating a spring washer.

* * * * *